US005395719A

United States Patent [19]

Jongewaard et al.

[11] Patent Number: 5,395,719

[45] Date of Patent: Mar. 7, 1995

[54] DYE RECEPTOR SHEET FOR THERMAL TRANSFER IMAGING

[75] Inventors: Susan K. Jongewaard, North St. Paul; Robert A. Braun, St. Paul, both of Minn.

[73] Assignee: Minnesota Mining and Manufacturing Company, St. Paul, Minn.

[21] Appl. No.: 217,384

[22] Filed: Mar. 24, 1994

[51] Int. Cl.[6] ..... G03C 5/54

[52] U.S. Cl. ..... 430/14; 430/200; 430/201; 430/213; 430/941; 503/227

[58] Field of Search ..... 430/200, 201, 203, 213, 430/941, 14; 503/227

[56] References Cited

U.S. PATENT DOCUMENTS 4,914,078 4/1990 Hann et al. ..... 503/227

4,968,658 11/1990 Beck et al. ..... 503/227

*Primary Examiner*—Richard L. Schilling

*Attorney, Agent, or Firm*—Gary L. Griswold; Walter N. Kirn; Mark A. Litman

[57] ABSTRACT

A dye transfer receptor sheet suitable for thermal dye transfer imaging is described which can provide a metal background to the transfered image. The receptor sheet comprises an organic polymeric substrate having a vapor deposited metal layer, a primer layer comprising a linear saturated thermoplastic polyester and a thermoset alkyd polyester, and a receiving layer.

8 Claims, No Drawings

DYE RECEPTOR SHEET FOR THERMAL TRANSFER IMAGING

FIELD OF THE INVENTION

This invention relates to thermal transfer printing, and in particular to a novel thermal transfer receptor sheet for such printing using a coated metallized-polymer surface as a receptor surface.

BACKGROUND OF THE INVENTION

In thermal dye transfer printing, an image is formed on a receptor sheet by selectively transferring a dye to a receptor sheet from a dye donor sheet placed in momentary contact with the receptor sheet. Material to be transferred from the dye donor sheet is directed by a thermal printhead, which consists of small electrically heated elements (print heads). These elements transfer image-forming material from the dye donor sheet to areas of the dye receptor sheet in an image-wise manner. Thermal dye transfer systems have advantages over other thermal transfer systems, such as chemical reaction systems, and thermal mass transfer systems. In general thermal dye transfer systems offer greater control of gray scale than these other systems, but they have problems as well. One problem is release of the dye donor and receptor layers during printing. This has been addressed often by the addition of dye-permeable release coatings applied to the surface of the dye receptor layer. Additionally, materials are required for use in the receptor layer having suitable dye permeability, mordanting properties, adhesion to the substrate, and long term light and thermal stability.

It is often desirable for imaging systems to be useful on different types of receptor substrates. This is particularly true in imaging systems used in proofing operations where the final image is to give the appearance of the final printed product. Where the final product is to be an image provided on a metal surface, it is difficult for many types of proofing systems to provide a realistic imaging system. Conventional photomechanical proofing systems which operate by using specialized photoresist or phototackifiable elements can not readily provide quality images on metal surfaces as they are not designed for such image productions.

Thermal dye transfer and thermal mass transfer often require special receptor surfaces to provide the highest quality images. Thermal mass transfer has been able to provide fairly accurate renditions of images on metallized surfaces by first transfering a metallic thermal mass transfer background and then transfering a colored image on top of or within the borders of the metallic image. Thermal dye transfer can not perform that type of two step image transfer because metallic appearing images or backgrounds are not readily provided by dyes or dye-like materials susceptible to the thermal dye transfer process. Recent advances in thermal dye transfer imaging systems describe thermal dye transfer receptor layers which can be coated out of solution and used on various surfaces to provide a high quality dye receiving layer. Such materials are described in U.S. Pat. Nos. 4,914,078 and 4,968,658. These layers are coated out of solution from presently acceptable solvents such as methyl ethyl ketone. These types of coating solutions were, however, not found to be useful on commercially available metallized (e.g., aluminized) polyester film. The most serious problem encountered in the use of these specialized dye receptive coatings was that the coating would not strongly adhere to the metallized surface. Even dye receptive coatings that were known to have good adherent properties to metal were found to suffer from poor adhesion to the metallized surface. It was discovered that the deposition of the vaporized metal onto the polymer surface caused the underlying polymer on the surface to decompose, usually into dimers, trimers and other lower molecular weight materials that would collect onto the surface of the metallized layer. These materials would act much like a release surface and greatly weaken the adherence of coatings applied thereto. Additionally, these materials would not remove easily when treated by washing with ketones, alcohols, acetones, tetrahydrofuran, or toluene. In fact, some of these solvents were not able to easily penetrate the coating formed by the decomposition product of the polymer which deposited itself on the surface of the vapor deposited metal.

Polyvinyl chloride derivatives and copolymers have been heavily used in thermal dye transfer receptor sheets as receptor layers, because of their properties in these areas. For example, U.S. Pat. No. 4,853,365 discloses that chlorinated polyvinyl chloride, used as a dye receptor, has good dye solubility and high dye receptivity. Similarly, vinyl chloride/vinyl acetate copolymers have also been used as receptor layers in thermal dye transfer receptor sheets as described in Japanese published application nos. 29,391 (1990) and 39,995 (1990). Japanese published application no. 160,681 (1989) discloses dye acceptance layers comprising polyvinyl chloride-polyvinyl alcohol copolymers, and Japanese published application nos. 43,092 (1990), 95,891 (1990) and 108,591 (1990) discloses dye image receiving layers comprising a hydroxy modified polyvinyl chloride resin and an isocyanate compound. U.S. Pat. No. 4,897,377 discloses a thermal transfer printing receiver sheet comprising a supporting substrate coated on at least one surface with an amorphous polyester resin. Published European patent application 133,012 (1985) discloses a heat transferable sheet having a substrate and an image-receiving layer thereon comprising a resin having an ester, urethane, amide, urea, or highly polar linkage, and a dye-releasing agent, such as a silicone oil, being present either in the image-receiving layer or as a release layer on at least part of the image receiving layer. Published European patent application 133,011 (1985) discloses a heat transferable sheet based on imaging layer materials comprising first and second regions respectively comprising (a) a synthetic resin having a glass transition temperature of from −100° to 20° C., and having a polar group, and (b) a synthetic resin having a glass transition temperature of 40° C. or above.

U.S. Pat. No. 4,968,658 teaches the use of a thermal transfer receptor surface with a receiver coating comprising a dye-receptive material, a dye-permeable release agent, and an alkoxylated Bisphenol A unsaturated polyester. Fumaric acid may also be used in the layer.

SUMMARY OF THE INVENTION

It is an aspect of the invention to provide a thermal dye or mass transfer receptor element in intimate contact with a dye or thermal mass transfer donor sheet, the receptor comprising a supporting substrate having on at least one surface thereof a dye or thermal mass transfer receptive receiving layer comprising a polymeric substrate having a vapor-deposited metal layer on at least one surface thereof. Coated on at least one of the surfaces having a vapor-deposited metal layer thereon is an optional primer layer coating comprising: a) a linear saturated thermoplastic polyester, and b) an optional alkyd thermoset polyester resin. The thermoset resin is preferably cured with a melamine crosslinking agent and/or a para-toluene sulfonic acid. The receptor sheet comprises the described metallized polymer substrate with the primer layer of the present invention thereon and a dye or thermal mass transfer receptor layer coated on the primer. The dye or thermal mass transfer receptive receiving layer is positioned in intimate contact with a dye or thermal mass transfer donor layer during the thermal transfer process.

It is another aspect of this invention to provide thermal transfer receptor sheets as described above wherein a polysiloxane release layer is coated on the dye or thermal mass transfer receptive receiving layer or a release agent is incorporated into the dye receptor layer.

The thermal transfer receptor sheets of the invention have good dye and mass transfer receptivity and excellent dye-image thermal stability properties, and can provide an accurate proofing image which resembles a printed image on a metal surface.

DETAILED DESCRIPTION OF THE INVENTION

The thermal dye and mass transfer receptor sheets of the invention comprise a supporting organic polymeric substrate having a vapor deposited metal layer, an optional primer layer comprising a mixture of a linear, saturated thermoplastic polyester adhesive and a thermoset (e.g., cured or crosslinked) polyester alkyd resin, and over said primer layer, a dye receptive layer. The receptive layer is optionally coated with a polysiloxane release layer or may contain release agents therein. The linear, saturated polyester thermoplastic adhesive and polyester alkyd resin can be incorporated within the receiving layer and further contain a crosslinking agent such as an isocyanate.

The dye or mass transfer image receptor layer of the present invention must be compatible as a coating with a number of resins for mass transfer and a number of dyes for thermal dye transfer. Since different dye transfer media manufacturers generally use different dye formulations in their donor sheets, the dye receiving layer should have an affinity for several different dyes. Because the transfer of dye from the dye donor sheet to the dye receptor sheet is essentially a contact process, it is important that there be intimate contact (e.g., no air gaps or folds) between the dye donor sheet and the dye receptor sheet at the instant of heating to effect imaging. Many different dye receptor layer compositions are known in the art and they are generally selected from polymer classes and mixtures thereof such as poly(vinyl chloride), chlorinated poly(vinyl chloride), vinyl acetate/vinyl chloride copolymers, silicone surfaces on polymeric bases, poly(methyl acrylate), polyvinyl acetals (e.g., polyvinyl butyral) and the like, which are preferred classes of polymers for receptor layers. Surface modifying agents and treatments to alter opacity, smoothness, adhesion of subsequent coatings, tint, and dye absorption are also conventionally used. When used as a dye receptive layer, poly(vinyl chloride) is often used with an additional resin, and usually additional or special plasticizers. Examples of such combinations may be found generally in the art and, for example, in EPO 227 091, EPO 228 066, EPO 133011, EPO 133012, and EPO 228 065. Since poly(vinyl chloride) is a rigid resin, the purpose of many of these additives is to plasticize the polymer.

Chlorinated poly(vinyl chloride) (CPVC) is a homopolymer of poly(vinyl chloride) that has been subjected to a chlorination reaction. CPVC has many of the good dye receptive properties of poly(vinyl chloride) and retains them at higher temperatures than PVC.

U.S. Pat. Nos. 4,990,485; 4,931,423; 4,927,666; 4,914,078; and 4,910,189 show receptor media which have compositions and constructions which could be used in combination with the layers of the present invention.

The proper selection of softening temperature (e.g. glass transition temperature, Tg) of the dye receiving layer is important in the preparation of the thermal dye transfer receptor sheet. Preferably the dye receiving layer for thermal dye transfer imaging should at least allow or enable increased solubilization of the dye, dye migration, dye permeation, and/or surface release of the dye between the donor and receptor surfaces below the temperatures employed to transfer dye from the dye donor sheet. The softening point, however, must not allow the resin to become distorted, stretched, wrinkled, etc. For use with thermal mass transfer imaging, the mass transfer receptor layer should be readily bonded to by mass transfer resins, and the resins with the pigments therein. In addition, the dye receptor sheet is preferably non-tacky and capable of being fed reliably into a thermal printer, and is of sufficient durability that it will remain useful after handling, feeding, and removal from imaging.

The dye or mass transfer receptor sheet may be prepared by introducing the various components for making the receiving layer with suitable solvents (e.g., tetrahydrofuran (THF), methyl ethyl ketone (MEK), toluene, and mixtures thereof. The resulting solutions are mixed at room temperature (for example), then the resulting mixture is coated onto the substrate and the resultant coating dried, preferably at elevated temperatures. Suitable coating techniques include knife coating, roll coating, curtain coating, spin coating, extrusion die coating, gravure coating, etc. The receiving layer is preferably free of any observable colorant (e.g., an optical density of less than 0.2, preferably less than 0.1 absorbance units). The thickness of the receiving layer is from about 0.001 mm to about 0.1 mm, and preferably 0.005 mm to 0.010 mm.

Materials that have been found to be particularly useful for forming the receiving layer include sulfonated hydroxy epoxy functional vinyl chloride copolymers as described in U.S. Pat. No. 4,910,189 and in another embodiment blends of sulfonated hydroxy epoxy functional vinyl chloride copolymers with other polymers. Any of the well known and/or commercially available materials known in the art as dye or thermal mass transfer receptor polymeric compositions may be used in the practice of the present invention. Polyvinyl resins, and especially polyvinyl chloride polymers and copolymers are widely used in the art. Chlorinated polyvinyl chlorides and their blends have also found wide acceptance. Other vinyl polymers and copolymers are also used in the art. Blends of resins are often used to achieve an appropriate balance of properties in the receiving layers of the art. The limiting factors to the resins chosen for the blend vary only to the extent of compounding necessary to achieve the property desired. Preferred blendable additives include, but are not limited to polyvinyl chloride, acrylonitrile, styrene-acrylonitrile copolymers, polyesters (especially bisphenol A fumaric acid polyester), acrylate and methacrylate polymers (especially polymethyl methacrylate), epoxy resins, and polyvinyl pyrrolidone. When an additional polymer, copolymer, or resin is used (as with an epoxidized, sulfonated polyvinyl chloride resin as in U.S. Pat. No. 4,910,189) the additional polymer is usually added in an amount of 75 percent by weight or less of the resinous composition of the dye or thermal mass transfer receiving layer, preferably in the amount of 25 to 75 percent by weight for non-release polymers, or 0.01 to 15% for release polymers.

Release polymers are characterized by low surface energy and include silicone and fiuorinated polymers. Non-limiting examples of release polymers are poly dimethyl siloxanes, perfluorinated polyethers, etc. Other conventional additives include, but are not limited to, surfactants, plasticizers, UV stabilizers, coating aids, and the like.

Suitable substrate materials may be any flexible material, optionally on which a metal layer may be vapor depositied. Suitable substrates may be smooth (preferably) or rough, transparent, opaque, and continuous or sheetlike. They may be porous or essentially non-porous. Preferred backings are white-filled or transparent polyethylene terephthalate or other temperature stable thermoplastic organic film forming polymers (e.g., polycarbonates, polyolefins, etc.) Non-limiting examples of materials that are suitable for use as a substrate include polyesters, especially polyethylene terephthalate, polyethylene naphthalate, polysulfones, polystyrenes, polycarbonates, polyimides, polyamides, cellulose esters, such as cellulose acetate and cellulose butyrate, polyvinyl chlorides and derivatives, polyethylenes, polypropylenes, etc. The substrate generally has a thickness of 0.02 to 1.5 mm, preferably 0.025 mm to 0.40 mm. If the substrate is supported by a liner or other supporting backing, then the preferred range for the substrate alone would be 0.0006 to 0.8 mm. The receptor substrate may be porous or non-porous, and individual layers of the receptor or donor sheet may be porous or non-porous so as to adjust thermal properties in the sheets and the transfer process.

By "non-porous" in the description of the invention it is meant that ink, paints or other liquid coloring media will not readily flow through the substrate (e.g., less than 0.05 ml per second at 7 torr applied vacuum, preferably less than 0.02 ml per second at 7 torr applied vacuum). The lack of significant porosity prevents absorption of the heated receptor layer into the substrate. However, porosity has also been found to be beneficial in localizing thermal events to the region of dye transfer and thereby increasing transfer efficiency and quality.

The substrates of the present invention may also have a supporting backing to help in transporting the media through the printer and the imaging device. This is essentially a non-critical, additional and optional structural feature. Such backings may be directly or adhesively adhered to the substrate.

The metals which may be used as the vapor deposited material may be essentially any metal which is capable of being vapor deposited. In practice, aluminum is the most dearly preferred material, but other metals such as tin, steel, iron, copper, brass, bronze, silver, gold, titanium, and the like may also have specialty applications. The metals may be coated with dyes, as part of the metal layer or as a separate layer(s) to improve tone, tint, or other visual aspects of coloration.

The thermal dye or mass transfer receptor layers of the invention are used in combination with a dye donor sheet wherein a dye image is transferred from the dye donor sheet to the receptor sheet by the application of heat. The heat may be applied by printheads, lasers, laser diodes, focused radiation, and the like, as is understood in the art. The finer the resolution of the applied heat, the finer the resolution of the image, within reasonable limits. The dye donor layer is placed in contact with the receiving layer of the receptor sheet and selectively heated according to a pattern of information signals whereby the dyes (or in the case of thermal mass transfer, the dyes or pigment in a binder) are transferred from the donor sheet to the receptor sheet. A pattern is formed thereon in a shape and density according to the intensity of heat applied to the donor sheet. The heating source may be an electrical resistive element, a laser (preferably an infrared laser diode), an infrared flash, a heated pen, or the like. The quality of the resulting image can be improved by readily adjusting the size of the heat source that is used to supply the heat energy, the contact position of the donor sheet and the receptor sheet, and the heat energy. The applied heat energy is controlled to give light and dark gradation of the image and for the efficient diffusion of the dye from the donor sheet to ensure continuous gradation of the image as in a photograph. Mass transfer imaging would give more limited gradation, but providing solid blocks (as in half tone imaging systems) for graphics, lettering borders, and the like. Thus, by using in combination with a dye donor sheet, the dye receptor sheet of the invention can be utilized in the print preparation of a photograph by printing, facsimile, or magnetic recording systems wherein various printers of thermal printing systems are used, or print preparation for a television picture, or cathode ray tube picture by operation of a computer, or a graphic pattern or fixed image for suitable means such as a Video camera, and in the production of progressive patterns from an original by an electronic scanner that is used in photomechanical processes of printing.

Suitable thermal dye transfer donor sheets for use in the invention are well known in the thermal imaging art. Some examples are described in U.S. Pat. No. 4,853,365 which is hereby incorporated by reference.

Other additives and modifying agents that may be added to the dye or mass transfer receiving layer include UV stabilizers, heat stabilizers, suitable plasticizers, surfactants, release agents, antistatic agents, etc., used in the receptor sheet of the present invention. Similarly, mass transfer receptor layers will contain additives that will facilitate the bonding and transfer of the mass transfer donor materials onto the receptor sheet.

In a preferred embodiment, the dye or mass transfer receiving layer of the invention is overcoated with a release layer or may contain release ingredients therein. The release layer must be permeable to the dyes used under normal transfer conditions in order for dye to be transferred to the receiving layer. Release materials suitable for this layer may be fluorinated polymers such as polytetrafluoroethylene, and vinylidene fluoride/vinylidene chloride copolymers, and the like, as well as dialkylsiloxane based polymers such as polydimethylsiloxane, modified organopolysiloxanes, polyvinyl butyral/siloxane copolymers such as Dai-Allomer TM SP- 711 (manufactured by Daicolor Pope, Inc., Rock Hill, S.C.) and urea-polysiloxane polymers.

Alternatively, improved release properties may be achieved by addition of a silicone or mineral oil to the receiving layer during formulation.

As previously noted, the primer layer composition of the present invention comprises a linear, saturated thermoplastic polyester and a thermoset alkyd polyester. Many different types and classes of polymer solutions were evaluated before identifying the primer compositions of the present invention as uniquely beneficial materials. It is additionally important to one aspect of the present invention that the adhesive could be coated out of ketone solutions (e.g., methyl ethyl ketone, methyl isobutyl ketone, etc.). This provides the element with a highly compatible solvent system which does not adversely affect other layers in the receptor element.

The preferred linear, saturated thermoplastic polyester adhesive present in the dye receiving element of the present invention is a polyethylene terephthalate adhesive having a molecular weight in the range of 10,000 to 40,000, preferably 15,000 to 30,000. Such polyesters are available from Bostik Chemical group, Emhart Corporation (e.g., Bostik 7695, 7651, 7614, and 7660) or from Goodyear Corp. (Vitel 3200, 3300, and 3550). These commercial Bostik adhesives are available in toluene/-MEK solvent solutions or MEK solutions, with viscosities ranging from 1200–1500 cps for 7695 to 110–160 cps for 7614. The Vitel resins are solids. An alkyd polyester is used in combination with the thermoplastic polyester, and the alkyd polyester is crosslinked, as with a melamine crosslinking agent. Such materials are also individually available (e.g., HKR 180, HydroKinetics Corp.) The alkyd polyester may be further crosslinked with materials such as para-toluene sulfonic acid and its salts.

A primer layer consisting of only the HKR 180 resin and para-toluene sulfonic acid as a crosslinker provided adequate adhesion for a vapor coated film initially. However, after the metal layer was overcoated with a thermal dye receiving layer, very poor adhesion was observed for both layers.

When the linear polyester adhesive (e.g., Bostik 7695) was coated by itself as a primer layer, it provided both good initial adhesion and good adhesion after application of a dye receptor layer. However, the linear polyester was too tacky and caused blocking of the coated film before application of the receptor layer. This made the intermediate difficult to work with, because it is desirable to coat the layers separately and then dry them after each coating.

EXAMPLES

The term "PVC" refers to polyvinyl chloride.

The term "PET" refers to polyethylene terephthalate.

The term "Meyer bar" refers to a wire wound rod such as that sold by R & D Specialties, Webster, N.Y.

The following dyes are examples of useful thermal dye transfer materials in the practice of one aspect of the present invention:

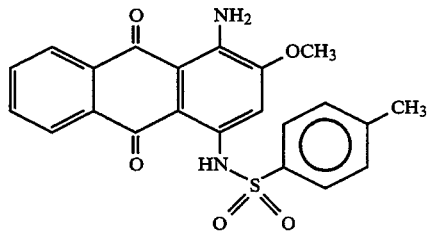

AQ-1

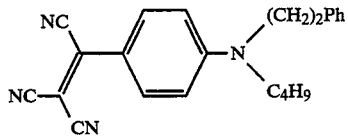

Mitsubishi Dye HSR-31
U.S. Pat. NO. 4,816,435

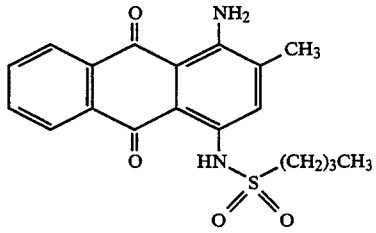

Butyl Magenta

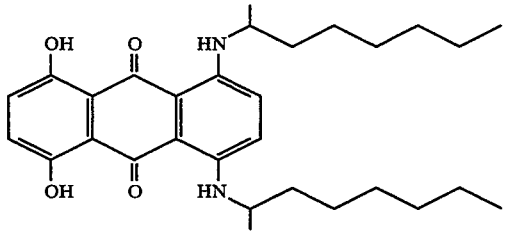

Octyl Cyan

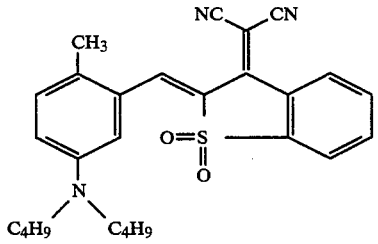

Foron Brilliant Blue

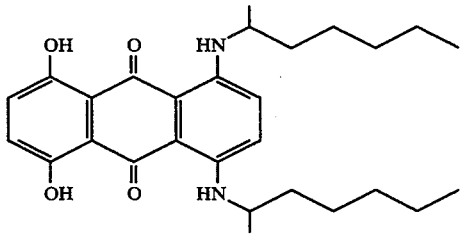

Heptyl Cyan

Butyl Magenta may be prepared as described in U.S. Pat. No. 4,977,134 (Smith et at.); HSR-31 was purchased from Mitsubishi Kasel Corp., Tokyo, Japan; AQ-1 was purchased from Alfred Bader Chemical (Aldrich Chemical Co., Milwaukee, Wis.); Foron Brilliant Blue was obtained from Sandoz Chemicals, Charlotte, N.C.; Heptyl Cyan and Octyl Cyan were prepared according to the procedures described in Japanese published application 60-172,591.

A preferred example of a thermal receptor material is a 10% solvent mixture of VYNS-3 (a vinyl chloride/vinyl acetate copolymer available from Union Carbide) and a multi-functionalized polyvinyl chloride (MR-120 available from Nippon Zeon). These two polymers are made into solutions with methyl ethyl ketone at a 12/1 ratio of VYNS-3 to MR-120. After thoroughly mixing this solution, 0.7% by weight (total solids) of Vitel PE 2200 (a copolyester resin made by Goodyear) and 1.5% by weight solids of Cyastat LS (a quaternary ammonium 3-lauramidopropyl triamethylammonium methylsulfate compound) were added. Prior to coating, KF 393 (a modified organopolysiloxane made by Shin-Etsu Chemical Co.) was added at a 0.07 to 1 ratio (with respect to the MR-120), which can be applied from solution. This solution was knife coated onto 2-mil (0.05 mm) PET film which has been coated with vapor-deposited aluminum and the primer composition of the present invention, the thermal receptor coating being applied at a 1 mil (0.025 mm) wet film thickness. This was a coating of about 275 mg/square foot dry coating weight.

A donor sheet was used to transfer the dye to the receptor using a thermal printer. One useful printer used in the practice of the present invention was a Kyocera raised glaze thin film thermal print head (Kyocera Corp., Kyoto, Japan) with 8 dots per mm and 0.3 watts per dot. In normal imaging, the electrical energy varies from 0 to 16 joules/cm$^2$, which corresponds to head voltages from to 14 volts with a 23 msec burn time. In all examples, the 3M Rainbow TM DeskTop Color Proofing system with 3M supplied donor ribbon was used.

Components used

VYNS - 3 -Vinyl chloride—vinyl acetate copolymer from Union Carbide

MR 120 -Vinyl chloride copolymer from Nippon Zion Co. Ltd.

KF 393 -Modified organopolysiloxane from Shin-Etsu

Bostik 7695 -Polyester adhesive, toluene/MEK solvent. 17° F. flash point, viscosity of 1200–1500 cps. Intrinsic viscosity of 0.9–1.0 centistrokes. Glass transition temperature −18° C.

The key features required of polyester additives within this invention were identified by studying a series of thermoplastic copolyesters having both aromatic and aliphatic groups. We also looked at resins with only aromatic groups and resins with only aliphatic groups and just aliphatic polymers.

We have found that the oligomers present on the surface of the vapordeposited film can not be washed off or readily penetrated by common solvents such as ketones, alcohols, acetones, tetrahydrofuran, or toluene. These oligomers, however, have been removed with the use of chlorinated solvents such as 1,2-dichloroethane. Since the use of chlorinated solvents is usually considered to be hazardous, the option of washing aluminum coated polyester is impractical.

Many different primers were tried in an effort to apply receptor coatings to the metallized surface of the polymers. Materials which are well known in the art as primers between metals and polymers were tried, and even polymers used with methylene chloride solvents could not penetrate the deposited detritus from the vapor deposition process. This failure prevented the formation of an effective bond between the receptor coating material and the metal. Amongst the materials tried according to the procedures of the present invention described above in the example were linear, saturated thermoplastic polyester (without additional additives), Vitel PE2200 polyester resin in MEK, Piccolastic D125 styrene resin (a solvent-soluble stryene resin), styrene/acrylonitrile, polyvinyl butyral, polycarbodiimide in methylene chloride and toluene, polyvinyl chloride in tetrahydrofuran, chlorinated poly(vinyl chloride), water soluble acrylic latex (in water), isooctyl acrylate/acrylic acid copolymer in acetone and heptane, octadecyl acrylate/methyl acrylate/acrylic acid copolymer in ethanol and toluene, and a styrene/butadiene elastomer in methyl ethyl ketone solution. These materials would suffer from such various defects as weak adhesion and, particularly in the case of the linear polyester, tackiness that rendered the material difficult to work with when applying further coatings.

The key features that the polyester additive must contribute to the dye receptive composition, comprising at least 50 percent polyvinyl chloride, Chlorinated polyvinyl chloride, or polyvinyl chloride/polyvinyl acetate copolymers, include:

1. Acceptable mass transfer.
2. Acceptable dye transfer.
3. Acceptable dye transfer image density (four color black > 2.0 ROD density units).
4. Adhesion to numerous metal surfaces.
5. Acceptable dye image stability to heat and light exposure.
6. Aceptable shelf life stability of the receptor surface prior to and after imaging.
7. Non blocking/no tack.
8. Film former/smooth, uniform coating in order to provide intimate contact with donor ribbon.

The polymers containing only aliphatic groups were polyester plasticizers such as Paraplex H-25 from Rohm and Haas (a sebacic acid polyester), Paraplex H-50 (an adipic acid polyester) and Plastolein 9750 from Emery Industries (an azalaic acid polyester). All aliphatic polyesters in this study failed to perform adequately in the dye receptor surface because of their inability to provide an adequate mass transfer surface due to the plasticizer's lower glass transition temperature, which produced an oily/liquid film surface. The aliphatic polyester plasticizers were generally mobile in the coated film and hindered dye stability and dye transfer uniformity. Due also to the characteristics of aliphatic polyester resins, poor adhesion to metallic substrates was observed.

The polyester polymers derived from aromatic groups such as those found in thermoplastic polyester films (e.g., Vitel 2200) fail to perform adequately as the dye receptor surface because of their low acceptance of dye image density and usually poorer dye stability to heat and light. Other aromatic derived resins similar to the Vitel 2200 such as polybutylene terephthalate (PBT) and polyethylene terephthalate (PET) consist of the following components respectively, (PBT)=terephthalic acid and 1,4 butanediol (PET)-

=terephthalic acid and ethylene glycol, showed similar problems.

Aromatic resins, aliphatic resins, and the aromatic-/aliphatic copolyester resin blends are all compatible with dye receptive vinyl chloride/vinyl acetate copolymer formulations. Results indicate that aliphatic aromatic copolyester resin blends (as mixtures of aliphatic and aromatic polymers and/or copolymers of aromatic and aliphatic monomeric units) impart better adhesion to metallic surfaces without detrimental side effects to the dye receptivity and stability. Generally the polyester resin should contain 5–95% by weight of aliphatic plus aromatic groups. The combination of aliphatic and aromatic groups in the polyester resin provides the unique properties of hardness and flexibility necessary for the thermal receptive film to function properly while maintaining adequate adhesion. Polyester resins like Vitel 2200 are too hard (high tensile strength and low elongation) and are unable to wet solvent insensitive substrates (metallic film). While aliphatic polyesters, like Plastolein 9750 have excellent wetting properties, they are too soft (low tensile strrength and elongation) which inhibits adhesion. The following materials are examples of copolyesters with aromatic and aliphatic functional groups used in this evaluation. Vitel 2200, which contains only aromatic groups is included as a reference material (see the table below).

| Raw Materials | Type | Bostik 7695 | Bostik 7660 | Bostik 7651 | Bostik 7614 | Vitel 2200 | Vitel 3200 | Vitel 3300 | Vitel 3550 | Vitel 3800 |
|---|---|---|---|---|---|---|---|---|---|---|
| Terephthalic Acid | A 1,4 | 24% | 14% | | | 25% | 33% | 24% | 15% | |
| Isophthalic Acid | A 1,3 | | 20% | | | 24% | | 9% | 10% | |
| Adipic Acid | C4 | 17% | 7% | | | | | | | |
| Sebacic Acid | C8 | 7% | 7% | | | | 15% | | | |
| Azelaic Acid | C7 | | | | | | | 15% | 24% | |
| 1,6 Hexanediol | S | 15% | 7% | | | | | | | |
| 1,4 Butanediol | S | | 42% | | | | | | | |
| Ethylene Glycol | S | 36% | | | | 26% | 32% | 31% | 51% | |
| Neopentyl Glycol | B | | | | | 24% | 20% | 20% | | |
| Tg °C. | | −18 | −15 | 20 | 56 | 63 | 12 | 11 | −15 | −33 |

A — Aromatic
S — Strait
B — Branched

Vitel 3800 has a higher aliphatic to aromatic ratio than the other Vitel resins shown in the table. Bostik 7651 and Bostik 7614 have a higher aromatic to aliphatic ratio than do the other Bostik resins.

All solutions were coated with a #32 Meyer bar, hot air gun dried and then placed into a 230° F. dry oven for 4 minutes. Coatings were done on 2 mil. aluminum vapor coated polyester film (A1-PET). All samples were imaged using the 3M Rainbow TM model 2710 Desk Top Color Proofing System. All density readings were taken with a Gretag SPM 100 densitometer.

Standard solution:

| Resin | Amount in grams |
|---|---|
| VYNS-3 (10% solids in MEK) | 24.0 |
| MR120 (10% solids in MEK) | 2.0 |
| Cyastat LS (10% solids in MEK) | 0.43 |
| KF393 (1.0% solids in MEK) | 1.4 |

To the standard solution above the following copolyester/polyester resins were added:

1. Bostik 7695 (12% solids in MEK) 14.2 grams
2. Vitel 3550 (10% solids in MEK) 17.0 grams
3. Vitel 3200 (10% solids in MEK) 17.0 grams
4. Vitel 3300 (10% solids in MEK) 17.0 grams
5. Vital 3800 (10% solids in MEK) 17.0 grams
6. Vital 2200 (10% solids in MEK) 17.0 grams
7. No other additives—standard solution only
8. Vitel 3550 alone—no standard solution
9. Vitel 3800 alone—no standard solution
10. Bostik 7695 alone—no standard solution Results:

| Sample | Base | Yellow | Magenta | Cyan | Black (4 color) |
|---|---|---|---|---|---|
| 1 | Al-PET | 1.23 | 1.00 | 0.91 | 1.50 |
| 2 | Al-PET | 1.30 | 0.94 | 1.07 | 1.60 |
| 3 | Al-PET | 1.12 | 0.98 | 0.99 | 1.47 |
| 4 | Al-Pet | 1.21 | 0.93 | 1.00 | 1.36 |
| 5 | Al-PET | 1.45 | 1.00 | 1.90 | — |
| 6 | Al-PET | Not tested due to the low imaging densities | | | |
| 7 | Al-PET Clear PET | 1.27 | 0.95 | 0.93 | 1.60 |
| 8 | Al-PET | Surface was too tacky to run through the printer and image. | | | |
| 9 | Al-PET | Surface was too tacky to run through the printer and image. | | | |
| 10 | Al-PET | Surface was too tacky to run through the printer and image. | | | |

The adhesion was good in samples 1, 3, and 4, very good in sample 2, fair to poor in example 5, and very poor in samples 6 and 7.

It can be concluded that polyester resins containing both aromatic and aliphatic groups provide the receptive layers of the present invention with improved adhesion to metal surfaces, uninhibited mass transfer and dye receptivity, minimal, negative, effects on dye image stability to heat and light, and good film forming characteristics.

As mentioned previously, the linear, saturated thermoplastic polyester adhesive can be incorporated within the dye or mass transfer receiving layer and additionally contain crosslinking agents such as isocyanates. This alternative embodiment does not require a prime layer and can be coated directly onto a metallized base without damaging the adhesion between the layers. Such a composition may have a formulation such as the following, which has been found to be effective in this practice:

| | |
|---|---|
| 14.2 grams | Bostik 7695 (12% solids in MEK) |
| 3.4 grams | Boscodur 21 (1% solids in MEK) |
| 2.0 grams | MR-120 (10% solids in MEK) |
| 24 grams | VYNS-3 (10% solids in MEK) |
| 1.4 grams | KF393 (1% solids in MEK) |
| 0.43 grams | Cyastat LS (10% solids in isopropanol/MEK) |

Boscodur 21 is a 4',4'-diphenylmethane diisocyanate, solvent based curing agent from Bostik, Inc.

We claim:

1. A thermal dye transfer system comprising a thermal transfer receptor element in intimate contact with a thermal donor sheet, said receptor element comprising a substrate having, on at least one surface thereof in contact with said transfer donor sheet, a vapor deposited metal layer, a primer layer comprising a linear saturated thermoplastic polyester having aliphatic and aromatic groups and a thermoset alkyd polyester, and a thermal mass transfer or dye receiving layer.

2. The system of claim 1 wherein said receptive layer is a thermal dye receiving layer which comprises a vinyl chloride copolymer having a compositional glass transition temperature between 55° and 70° C., a weight average molecular weight between 20,000 and 60,000 g/mol, a hydroxyl equivalent weight between 1500 and 4000 g/mol, a sulfonate equivalent weight between 9,000 and 23,000 g/mol, and an epoxy equivalent weight between 500 and 7000 g/mol.

3. An image bearing sheet comprising a substrate having, on at least one surface thereof a vapor depositied metal layer, a primer layer comprising a linear saturated thermoplastic polyester and a thermoset alkyd polyester, and a receiving layer with an image thereon.

4. The sheet of claim 3 wherein said receiving layer is a thermal transfer dye receiving layer which comprises a vinyl chloride copolymer having a glass transition temperature between 59° and 65° C., a weight average molecular weight between 25,000 and 55,000 g/mol, a hydroxyl equivalent weight between 1890 and 3400 g/mol, a sulfonate equivalent weight between 11,000 and 19,200 g/mol, and an epoxy equivalent weight between 500 and 7000 g/mol, and on said dye receptive layer at least one dye distributed in an imagewise manner.

5. The thermal transfer system of claim 3 wherein a polysiloxane release layer is coated on or in said receiving layer.

6. The thermal transfer imaging system comprising a thermal mass transfer receptor sheet in intimate contact with a thermal mass transfer donor sheet, said receptor sheet comprising a substrate having on at least one surface thereof in contact with said thermal mass transfer donor sheet, a vapor deposited metal layer, a primer layer comprising a linear, saturated thermoplastic polyester and a thermoset alkyd polyester, and a thermal mass transfer receiving layer.

7. An image beating sheet comprising a substrate having on at least one surface thereof a vapor deposited metal layer, a primer layer comprising a linear, saturated thermoplastic polyester and a thermoset alkyd polyester, and a thermal mass transfer receiving layer having a thermal mass transfer image thereon.

8. The sheet of claim 7 wherein said receiving layer also has a polysiloxane on or in said receiving layer.

* * * * *

UNITED STATES PATENT AND TRADEMARK OFFICE

CERTIFICATE OF CORRECTION

PATENT NO. : 5,395,719

DATED : March 7, 1995

INVENTOR(S) : Jongewaard et al.

It is certified that error appears in the above-indentified patent and that said Letters Patent is hereby corrected as shown below:

Column 9, line 38, delete "from to 14 volts", and insert --from 0 to 14 volts--.

Column 14, line 26, delete "beating", and insert --bearing--.

Signed and Sealed this

Fifth Day of September, 1995

*Attest:*

*Attesting Officer*

BRUCE LEHMAN

*Commissioner of Patents and Trademarks*